US006725812B1

(12) United States Patent
Scott

(10) Patent No.: US 6,725,812 B1
(45) Date of Patent: Apr. 27, 2004

(54) WATER PUMP DRIVEN BY VISCOUS COUPLING

(75) Inventor: George Edward Scott, Marshall, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 09/728,015

(22) Filed: Dec. 1, 2000

(51) Int. Cl.[7] ..... F01P 5/10
(52) U.S. Cl. ..... 123/41.44; 192/58.4; 417/223
(58) Field of Search ..... 123/41.44, 41.46, 123/41.47; 192/58.4; 417/223

(56) References Cited

U.S. PATENT DOCUMENTS

| | | | |
|---|---|---|---|
| 3,272,188 | A | 9/1966 | Sabat |
| 4,295,798 | A | 10/1981 | McIntosh |
| 4,460,056 | A | 7/1984 | Jaccod |
| 4,502,345 | A | 3/1985 | Butterfield |
| 4,662,320 | A | 5/1987 | Moriya |
| 4,685,355 | A | 8/1987 | Kaneyuki |
| 4,691,668 | A | 9/1987 | West |
| 4,878,401 | A | 11/1989 | Chung |
| 4,969,857 | A | 11/1990 | Kumm |
| 5,076,216 | A | 12/1991 | Ro |
| 5,233,952 | A | 8/1993 | Isaka |
| 5,700,212 | A | 12/1997 | Meckstroth |
| 5,732,667 | A | 3/1998 | Sakurai |
| 6,021,747 | A | 2/2000 | Gee et al. |

FOREIGN PATENT DOCUMENTS

EP 0-641947 A2 * 7/1994

* cited by examiner

*Primary Examiner*—Noah P. Kamen
(74) *Attorney, Agent, or Firm*—Artz & Artz, P.C.; Greg Dziegielewski

(57) ABSTRACT

A viscous coupling, or clutch system, is either coupled to a water pump or combined with a water pump and is used for controlling the coolant flow rate in a cooling system. At engine idle or low speeds, wherein the water pump is driven at very close speeds to the input speed, the viscous coupling would have little effect on the speed of the pump. However, due to the presence of the viscous coupling, a larger water pump may be used, resulting in good coolant flow at engine idle or lower speeds. As engine speeds are increased, the viscous coupling slips, resulting in lower input speeds for the water pump, thereby reducing the risk of pump cavitation. By increasing the water pump speed at lower engine speeds and decreasing the water pump speed at higher engine speeds, the engine likely will operate at ideal temperatures, and thus fuel economy may be improved and emissions minimized.

9 Claims, 4 Drawing Sheets

WATER PUMP DRIVEN BY VISCOUS COUPLING

TECHNICAL FIELD

The invention relates generally to water pumps and more specifically to a water pump driven by a viscous coupling.

BACKGROUND ART

Water pumps are typically used on vehicles today to provide heat transfer means for an engine during operation. The engine crankshaft typically drives water pumps at a fixed ratio. Thus, as the engine idle speed is reduced, as is the trend in vehicles today to reduce emissions, the water pump speed is correspondingly reduced. This reduction in water pump speed results in a reduction in the coolant flow through the cooling system which can result in poor heater output for the interior of the vehicle when needed in cold weather and also can result in poor coolant flow for engine cooling during hot weather.

Increasing the water pump speed by increasing the drive ratio from the crankshaft will increase the coolant flow at engine idle speeds, but it may result in overspeeding the pump at higher engine speeds which may produce pump cavitation and reduced water pump bearing life. Pump cavitation can result in pump damage and a reduction in cooling system performance. current state of the art is to add an auxiliary water pump, typically electrically driven, to provide additional coolant flow at low engine idle speeds. Another approach is to use moveable vanes in the inlet of the water pump to throttle the coolant flow at higher engine speeds.

It is thus an object of the present invention to provide good coolant flow at low engine idle speeds while avoiding pump cavitation at higher engine speeds without the need for an auxiliary water pump or moveable vanes.

SUMMARY OF THE INVENTION

The above and other objects of the invention are met by the present invention that is an improvement over known water pumps.

The present invention provides a viscous coupling, or clutch, positioned on the input shaft of the water pump. At engine idle or low speeds, wherein the water pump is driven at very close speeds to the input speed, the viscous coupling has minimal effect on the speed of the pump. However, due to the presence of the viscous coupling, a larger water pump may be used, resulting in good coolant flow at engine idle or lower speeds.

As engine speeds are increased, the viscous coupling slips, resulting in lower input speeds for the water pump, thereby reducing the risk of pump cavitation. This may also increase the life of the water pump bearing.

In an alternative preferred embodiment, the body of the viscous coupling can be designed to be immersed in engine coolant, which would enhance the removal of heat due to slip from the viscous coupling at high speed slip conditions.

Other features, benefits and advantages of the present invention will become apparent from the following description of the invention, when viewed in accordance with the attached drawings and appended claims.

BEST MODE(S) FOR CARRYING OUT THE INVENTION

Figure 1:
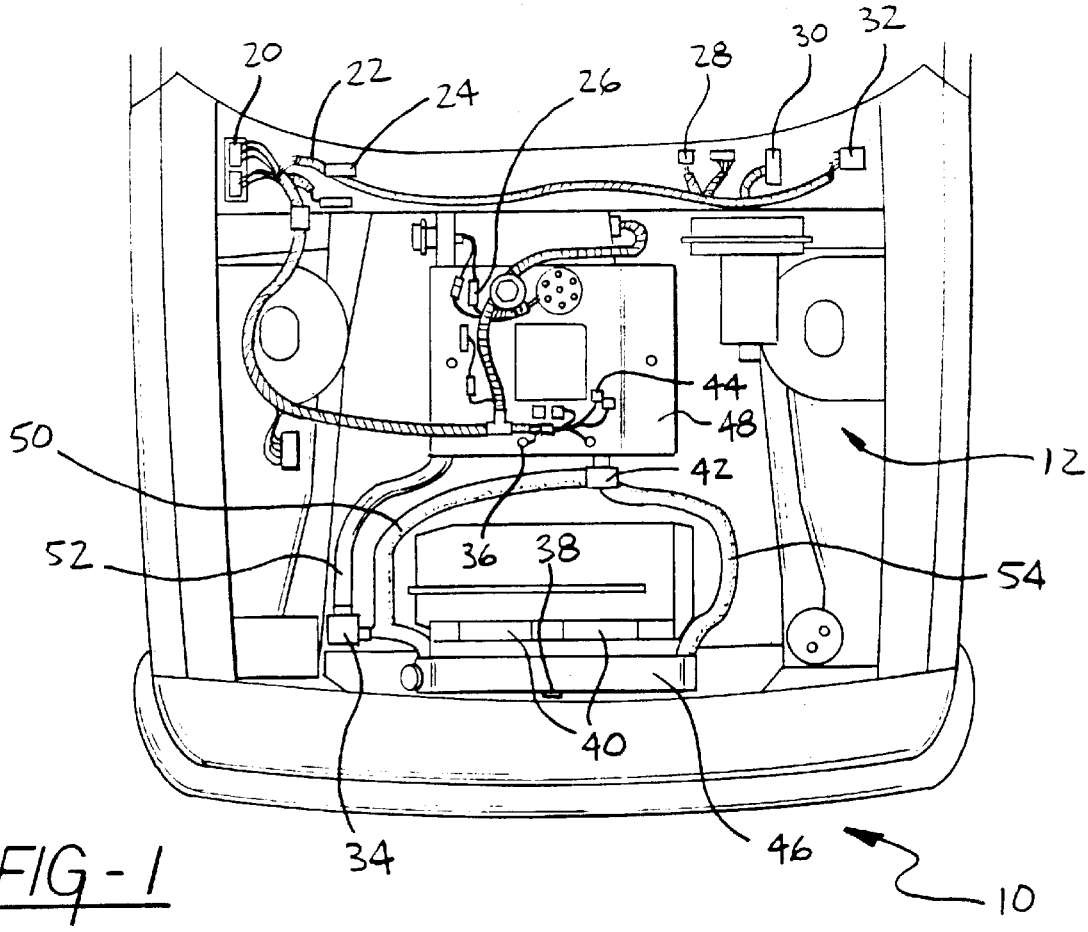
FIG. 1 is a schematic representation of a cooling system according to the prior art.

Referring now to FIG. 1, a vehicle 10 is illustrated having a cooling system 12 according to one embodiment in the prior art. The cooling system 12 depicted has a powertrain control module 20, a computer control harness 22, a check engine lamp driver 24, a cylinder head temperature sensor 26, a check engine light 28, a vehicle speed sensor 30, a fuse panel 32, an electric water pump 34, an engine coolant sensor 36, an ambient temperature sensor 38, a pair of electric cooling fans 40, a flow control valve 42, a throttle position sensor 44, and a radiator 46.

In operation, when an internal combustion engine 48 is started, coolant (not shown) enters the electric water pump 34 through a branch duct 50 from the radiator 46. Coolant is then pumped out of the water pump 34 through a return duct 52 and into the cooling passages (not shown) of the engine 48. The coolant flows through the engine to the flow control valve 42. Coolant will then flow back to the radiator 46 through the supply duct 54 or be bypassed through the branch duct 50 depending upon the engine coolant temperature as determined by the engine coolant temperature sensor 36. When the engine 48 is cool, the flow control valve 42 directs the coolant through the branch duct 50. If the engine 48 is warm, the flow control valve 42 directs the coolant through the supply duct 54 to the radiator 46, where the coolant is cooled. It will be understood that, as used herein, the term "coolant" is used interchangeably as engine coolant, such as antifreeze, or water.

One problem with the currently available engine driven water pumps is that the speed of rotation of the water pump is, at all times, tied to the speed of the engine 48. As such, during engine idle modes, when speed of the engine 48 is low, the flow rate of water through the system is correspondingly low. As engine idle speeds are lowered further for emissions purposes, this flow rate will correspondingly decrease. Further, as the speed of the engine 48 increases, the rotational speed of the water pump correspondingly increases. At these higher rates of rotational speed, water pump cavitation may occur, wherein the amount of coolant that is capable of being pumped through the water pump cannot keep up with the rotational speed of the impellers (not shown) within the water pump. This creates a vacuum within the water pump and may lead to pump damage. Finally, during normal operating conditions, this higher rotational speed typically is not needed to maintain the engine 48 within acceptable temperature ranges, thus the excess rotational speed is not necessary for optimal operation of the engine 48 and coolant system 12. Further, the excess torque created has an adverse effect on fuel economy and emissions.

To alleviate these concerns, the present invention controls the water pump speed by coupling a viscous coupling to the water pump. Two preferred embodiments of the present invention having the viscous coupling are depicted below in FIGS. 2 and 3.

Figure 2:
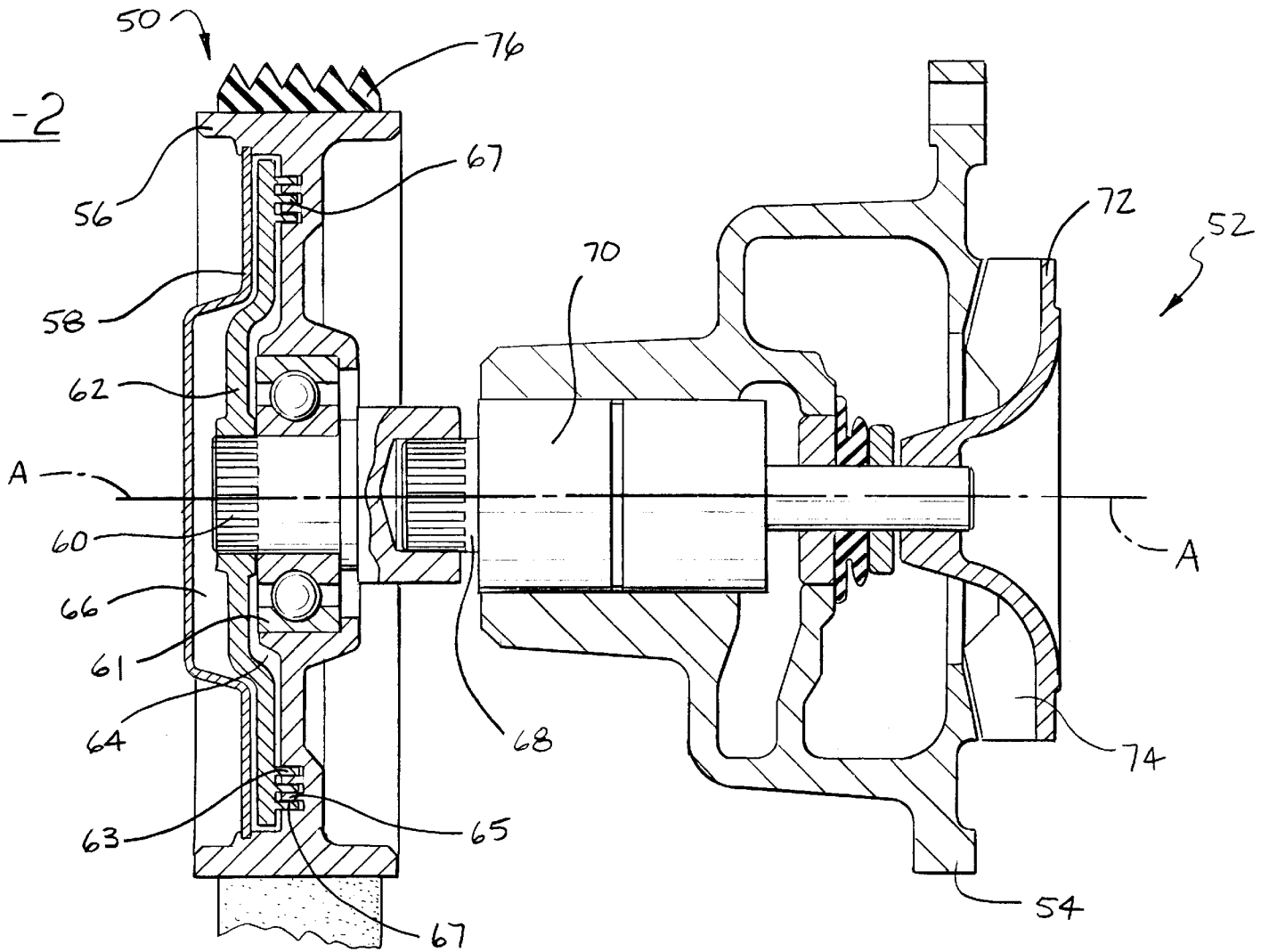
FIG. 2 is a cooling system having a viscous coupling and larger water pump according to one embodiment of the present invention.

Referring now to FIG. 2, a viscous coupling 50 is shown coupled to the housing 54 of a water pump 52. The coupling 50 has a pulley 56 coupled to an outer cover 58 and supported to a clutch shaft 60, or input shaft, by a bearing 61. A clutch plate 62 is disposed between the cover 58 and pulley 56 and is coupled to the shaft 60. The clutch plate 62 and pulley 56 define a working chamber 64, while the opposite side of the clutch plate 62 and cover 58 define a reservoir 66. In addition, the clutch plate 62 and the pulley 56 each have a series of grooves 63, 65 that interlock and define a shear area 67 within the working chamber 64. A viscous fluid, typically silicone-based, is contained within the working chamber 64 and reservoir 66. The clutch shaft 60 is coupled to a water pump shaft 68 that is supported by a water pump bearing 70 within the housing 54. The water pump shaft 68 is coupled to the water pump impeller 72 contained within the coolant chamber 74 of the water pump 52.

A drive belt 76 coupled to the outside of the pulley 56 and a crankshaft pulley (not shown) rotates in response to crankshaft (not shown) rotation controlled by engine speed. The drive belt 76 causes the pulley 56 to rotate around the clutch shaft 60 about axis A—A. The rotational action of the pulley 56 causes viscous fluid contained within the shear area 67 to shear at a rate proportional to the speed of rotation of the pulley 56. This shearing action of the viscous fluid produces torque within the shear area 67 that causes the clutch plate 62 to rotate about axis A—A. The speed of rotation of the clutch plate 62, and hence the impellers 72, is a function of engine speed and the amount of slip created in the shear area 67. This torque created in the shear area 67 causes the clutch shaft 60 to rotate about axis A—A, which causes the water pump shaft 58 to rotate and turn the impellers 72 within the cooling chamber 74, thereby causing engine coolant to flow in and out of the cooling chamber 74 and throughout the cooling system to cool the engine.

Of course, while the shear area 67 as described above is defined by the series of grooves 63, 65, it is understood that the shape and size of the working area may vary and still allow for the creation of shear that is necessary to drive the clutch shaft 62 and hence the impellers 72. For example, the shear area 67 could be defined by two flat surfaces, or two slightly raised areas, and still create shearing of the viscous fluid. Thus, depending upon the performance characteristics required, the design characteristics of the clutch plate 62 and pulley 56 creating the shear area 67 can be varied greatly and still come within the scope of the present invention.

In an alternative preferable arrangement, the water pump is driven by a viscous coupling that is substantially contained within the impeller chamber. This creates a water-cooled viscous coupling. This would help to minimize the possibility of viscous fluid breakdown (gelatination) that can occur at higher temperatures, thereby potentially prolonging the workable life of the viscous coupling and water pump.

Figure 3:
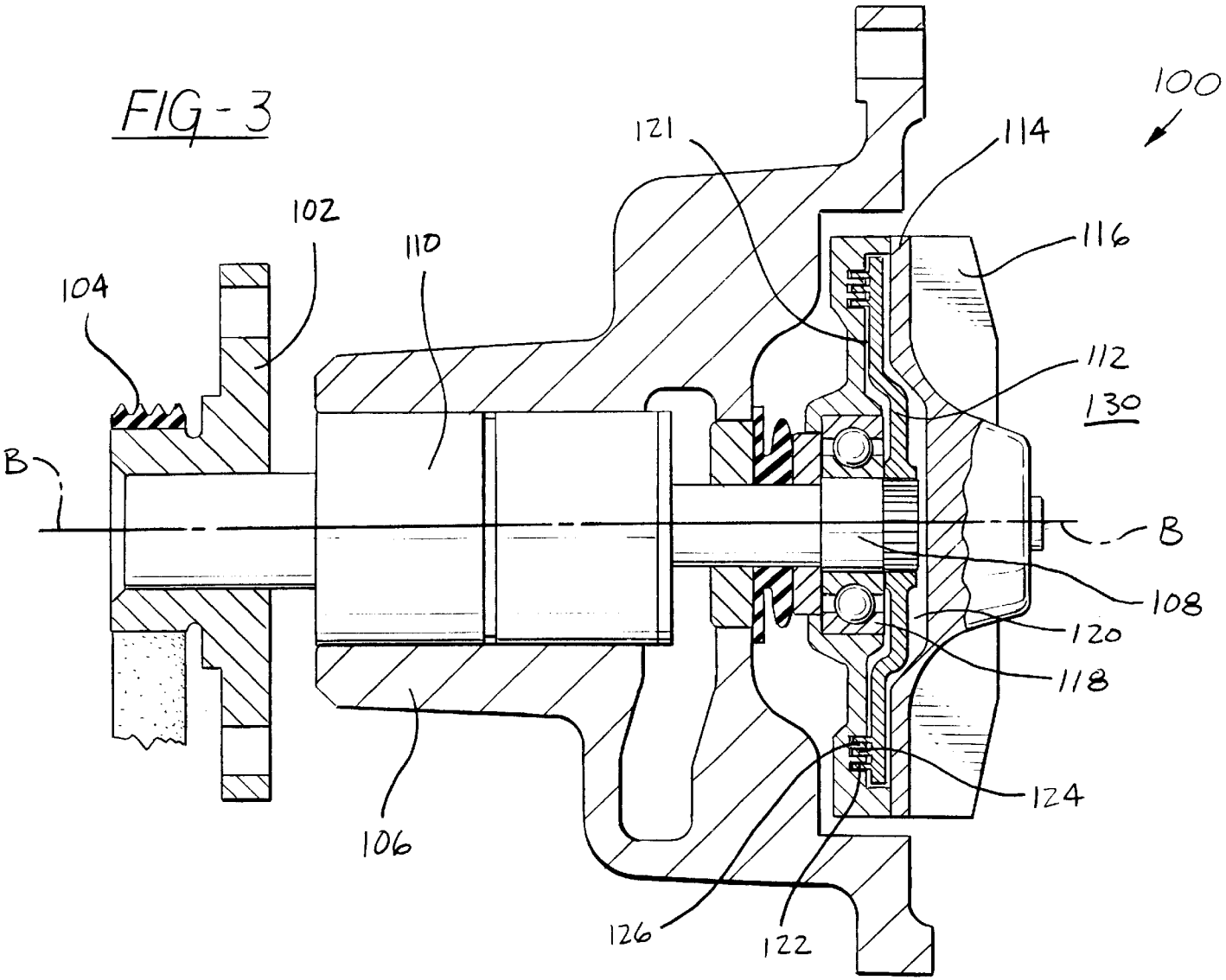
FIG. 3 is a cooling system having a coolant-cooled viscous coupling and larger water pump according to another embodiment of the present invention.

Referring now to FIG. 3, the water-cooled viscous coupling 100 shows an outer rotating portion 102 coupled with a drive belt 104. The outer rotating portion 102 has a water pump bearing shaft 108 that is rotatably coupled to a water pump housing 106 with a water pump bearing 110. A clutch plate, or clutch 112, is coupled to the water pump bearing shaft 108. An impeller assembly 114 having a plurality of impellers 116 is rotatably coupled to the water pump bearing shaft 108 with a bearing 118. The clutch 112 and impeller assembly 114 together define a fluid reservoir 120. The fluid reservoir 120 has a working chamber 121 having a viscous shear area 122 defined between a plurality of interlocking grooves 124, 126 contained on the impeller assembly 114 and clutch 112, respectively.

When the engine is running, a crankshaft coupled to a crank pulley causes rotation of the crank pulley. The drive belt 104, which is coupled to the crank pulley, rotates in response. This causes the outer rotating portion 102, water pump bearing shaft 108, and clutch 112 to rotate in response. As the clutch rotates, viscous fluid contained within the viscous shear area 122 is sheared at a rate proportional to the speed of rotation of the drive belt 104 and the amount and viscosity of the viscous fluid. This shearing action produces torque that causes the impeller assembly 114 to rotate about axis B-B. This causes the impellers 116 to spin, thereby causing the movement of engine coolant throughout the cooling system. Engine coolant flowing on the outside of the impeller assembly 114 in the engine coolant region 130 is used to dissipate heat generated by the shearing of the viscous fluid. This heat dissipation prevents the breakdown of the viscous fluid.

Figure 4:
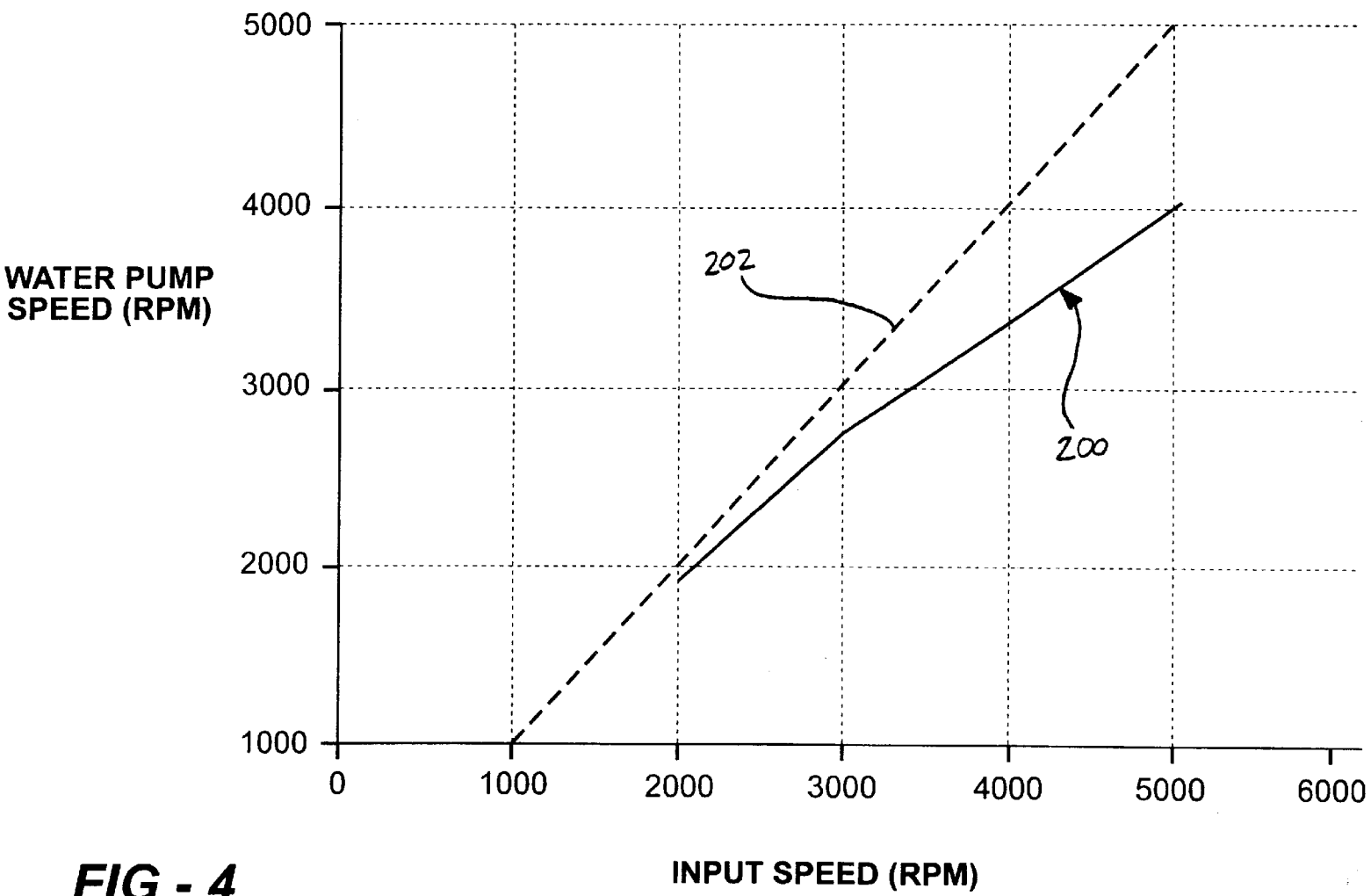
FIG. 4 is a graph comparing the input speed and water pump speed of a water pump according to the prior art versus a water pump having viscous coupling according as described in FIG. 2.

FIG. 4 compares output speeds to water pump speeds for a cooling system having a viscous coupling according to the present invention, as depicted by solid line 200, versus a cooling system not having a viscous coupling, as depicted by dashed line 202.

At low engine speeds, such as engine idle speeds, there is very little slip within the viscous coupling, hence the water pump speed increases at a rate similar to the increase in input speed from the engine 48. For example, at an input speed of 2000 rpm, the water pump 52 speed was approximately 1975 rpm, representing about a 1.1% loss, or slip. As the engine speed increases further, the slip increases, thereby decreasing the water pump speed relative to the input speed. For example, at an input speed of 5000 rpm, the output speed of the water pump 52 was approximately 4000 rpm, representing a 20% slip. This slippage is due to the shearing of the viscous fluid contained within the working chamber 64. As engine speed increases further to high engine speeds, a theoretical maximum water pump speed is reached (not depicted on FIG. 4), relating to the point wherein the maximum shear rate of the viscous fluid within the working chamber 64 of the viscous coupling 50 occurs. This maximum speed is less than the speed wherein pump cavitation typically occurs, yet is great enough to provide adequate cooling to an engine at high engine speeds. Thus, water pump damage associated with pump cavitation and higher pumping speeds can be minimized or eliminated while still providing good coolant flow to the engine.

The addition of a viscous coupling in the embodiments as depicted in FIGS. 2 and 3 to the cooling system allows a larger water pump to be used compared with traditional cooling systems. This allows larger coolant flow at lower engine speeds, which improves engine performance by warming the engine to optimal performance levels more quickly, thereby improving fuel economy and emissions. At higher engine speeds, where a larger water pump in the prior art would produce too much coolant flow to the engine, the viscous coupling 50, 100 serves to limit the impeller 72, 116 speed, and hence coolant flow, to the engine.

The present invention offers significant advantages over typical cooling systems. First, the viscous coupling limits the water pump speed at higher engine speeds by creating slip between the input speed to the viscous coupling and output speed of a water pump shaft that drives the water pump. This helps to prevent pump cavitation, which occurs when the rotational speed of the water pump shaft spins the impellers too fast. This can create a vacuum effect within the coolant chamber that may overheat the water pump seal and lead to damage of the water pump bearings. This vacuum effect may also lead to damage of the water pump impellers. Further, the viscous coupling helps to prevent cooling system damage caused by coolant flowing through the cooling system at a high rate of flow by limiting the amount of flow to a finite level less than the maximum speed of an engine.

At the same time, the size of the water pump may be increased when coupled to the viscous coupling to provide higher coolant flow at low engine speeds to help warm up the engine during starting or engine idle conditions. This serves to improve fuel economy and limit emissions by allowing an engine having the viscous coupling quickly warm up to its ideal temperature range. Within this temperature range, the engine runs at peak efficiency.

In addition, by limiting the amount of coolant flow at higher engine speeds, the temperature of the engine can be maintained within its ideal temperature range. This also improves fuel economy and limits emissions.

Finally, by immersing the viscous coupling in engine coolant, as in FIG. 3, the life of the viscous coupling, and consequently the life of the water pump, can be increased.

While the best modes for carrying out the present invention have been described in detail herein, those familiar with the art to which this invention relates will recognize various alternate designs and embodiments for practicing the invention as defined by the following claims. All of these embodiments and variations that come within the scope and meaning of the present claims are included within the scope of the present invention.

What is claimed is:

1. A viscous coupling 50 operatively coupled to a water pump 52 in an internal combustion engine, the viscous coupling comprising:

a clutch shaft 60 coupled to a water pump shaft 68 of the water pump 52;

a clutch plate 62 coupled to said clutch shaft 60, said clutch plate 62 having a clutch shear area;

a pulley 56 operatively connected to said clutch shaft by a bearing 61, said pulley 56 capable of independently rotating around said clutch shaft 60 when a drive belt 76 coupled to said pulley 56 and an engine crankshaft is rotated, said pulley 56 having a pulley shear area;

a cover 58 coupled to said pulley 56, said cover 58 and said clutch plate 62 defining a reservoir 66;

a working chamber 64 defined by said pulley 56 and said clutch plate 62;

a shear area 67 defined by said clutch shear area and said pulley shear; and a viscous fluid contained within said reservoir 66, said working chamber 64, and said shear area 67, wherein said rotation of said pulley 56 around said clutch shaft 60 in response to movement of said drive belt 76 causes said viscous fluid to shear in said shear area 67, thereby creating torque to drive said clutch plate 62 in response to the torque, thereby causing rotation of said clutch shaft 60 and said water pump shaft 68.

2. The viscous coupling 50 of claim 1, wherein said clutch shear area comprises a first plurality of grooves 63 and wherein said pulley shear area comprises a second plurality of grooves 65, wherein one of said first plurality of grooves 63 is intercoupled between two adjacent of said second plurality of grooves 65.

3. The viscous coupling of claim 1, wherein said viscous fluid comprises a silicon-based fluid.

4. The viscous coupling of claim 1, wherein said viscous coupling is a water-cooled viscous coupling.

5. A method for controlling engine coolant flow through an engine cooling system, the method comprising the step of:

operatively coupling a viscous coupling to a crankshaft pulley with a drive belt, said crankshaft pulley being coupled to an engine crankshaft and capable of rotating at a speed equal to the rotational speed of the engine crankshaft, wherein said engine crankshaft rotational speed is a function of the speed of an engine;

wherein said viscous coupling comprises a clutch shaft 60 coupled to a water pump shaft of the water pump; a clutch plate coupled to said clutch shaft, said clutch plate having a clutch shear area; a pulley 56 operatively connected to said clutch shaft by a bearing, said pulley capable of independently rotating around said clutch shaft when a drive belt coupled to said pulley and an engine crankshaft is rotated, said pulley having a pulley shear area; a cover coupled to said pulley, said cover and said clutch plate defining a reservoir; a working chamber defined by said pulley and said clutch plate; a shear area defined by said clutch shear area and said pulley shear; and a viscous fluid contained within said reservoir, said working chamber, and said shear area, wherein said rotation of said pulley around said clutch shaft in response to movement of said drive belt causes said viscous fluid to shear in said shear area, thereby creating torque to drive said clutch plate in response to the torque, thereby causing rotation of said clutch shaft and said water pump shaft;

operatively coupling said viscous coupling to the water pump such that said working chamber of said viscous coupling is located externally with respect to a water pump housing, said water pump having an impeller; and engaging said viscous coupling to control the rotational speed of said impeller as a function of the speed of the engine.

6. The method of claim 5, wherein the steps of operatively coupling a viscous coupling to a crankshaft pulley with a drive belt and operatively coupling said viscous coupling to a water pump comprises the steps of:

operatively coupling a water-cooled viscous coupling 100 having an impeller 116 to a crankshaft pulley with a drive belt 104, said crankshaft pulley being coupled to an engine crankshaft and capable of rotating at a speed equal to the rotational speed of the engine crankshaft, wherein said engine crankshaft rotational speed is a function of the speed of an engine.

7. The method of claim 6, wherein the step of engaging said water-cooled viscous coupling to control the rotational speed of the impeller 116 as a function of the speed of the engine comprises the steps of:

rotating an engine crankshaft at a first rotational speed equal to the speed of the engine, wherein said rotation of said engine crankshaft induces rotation of said coupled crankshaft pulley and said drive belt 104, wherein the rotation of drive belt 104 induces rotation of an outer rotating portion 102 of said water-cooled viscous coupling 100, wherein said rotation of said outer rotating portion 102 in turn rotates a water pump bearing shaft 108 coupled to said outer rotating portion 102, wherein said rotation of said water pump bearing shaft 108 in turn rotates a clutch plate 112 coupled to said water pump bearing shaft 108, wherein the rotation of said clutch plate 112 creates shearing of a viscous fluid contained within a shear area 122, said shear area 122 defined between an impeller assembly shear area of an impeller assembly 114 and a clutch shear area of said clutch plate 112, wherein said shearing drives a rotational response of said impeller assembly 114 at a second rotational speed, thereby rotating said impeller assembly 114 rotatably mounted to said water pump bearing shaft 108 at said second rotational speed, thereby rotating an impeller 116 coupled to said impeller assembly 114 to pump engine coolant through the cooling system.

8. The method of claim 7, wherein said second rotational speed is a function of a shearing rate of said viscous fluid within said shear area 122 at said first rotational speed.

9. The method of claim 8, wherein said shearing rate is also a function of the amount of said viscous fluid contained within said shear area 122, the viscosity of said viscous fluid contained within said shear area 122, the composition of said viscous fluid, the shape of said impeller assembly shear area, and the shape of said clutch shear area.

* * * * *